US011866283B2

(12) United States Patent
Holtman et al.

(10) Patent No.: US 11,866,283 B2
(45) Date of Patent: Jan. 9, 2024

(54) SHEET STACKING APPARATUS

(71) Applicant: Canon Production Printing Holding B.V., Venlo (NL)

(72) Inventors: Lodewijk T. Holtman, Venlo (NL); Fabian T. Rosenboom, Venlo (NL); Hermanus M. Kuypers, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 17/405,360

(22) Filed: Aug. 18, 2021

(65) Prior Publication Data

US 2022/0063949 A1 Mar. 3, 2022

(30) Foreign Application Priority Data

Sep. 1, 2020 (EP) ..... 20193966

(51) Int. Cl.

| | |
|---|---|
| ***B65H 31/26*** | (2006.01) |
| ***B65H 29/10*** | (2006.01) |
| ***B65H 29/04*** | (2006.01) |
| ***B65H 31/34*** | (2006.01) |

(52) U.S. Cl.

CPC ..... *B65H 31/26* (2013.01); *B65H 29/10* (2013.01); *B65H 31/34* (2013.01); *B65H 2301/331* (2013.01); *B65H 2301/4211* (2013.01); *B65H 2301/4212* (2013.01); *B65H 2301/44712* (2013.01)

(58) Field of Classification Search

CPC ..... B65H 31/26; B65H 31/34; B65H 29/041; B65H 29/10; B65H 2301/331; B65H 2301/4211; B65H 2301/4212; B65H 2301/44712

See application file for complete search history.

(56) References Cited

U.S. PATENT DOCUMENTS

| | | | | |
|---|---|---|---|---|
| 6,095,518 | A | 8/2000 | Allmendinger et al. | |
| 9,840,389 | B2 * | 12/2017 | Lewalski | B65H 29/04 |
| 2012/0267845 | A1 | 10/2012 | Rutten et al. | |
| 2013/0221596 | A1 | 8/2013 | Watanabe et al. | |
| 2019/0135573 | A1 * | 5/2019 | Anezaki | B65H 29/28 |

(Continued)

FOREIGN PATENT DOCUMENTS

| | | | |
|---|---|---|---|
| DE | 197 22 295 | A1 | 12/1998 |
| JP | 6-87555 | A | 3/1994 |

(Continued)

OTHER PUBLICATIONS

European Search Report, issued in Application No. 20 19 3966, dated Feb. 18, 2021.

*Primary Examiner* — Luis A Gonzalez

(74) *Attorney, Agent, or Firm* — Birch, Stewart, Kolasch & Birch, LLP

(57) ABSTRACT

A sheet stacking apparatus includes a sheet alignment mechanism configured for aligning a sheet in a predetermined reference position; a gripper arrangement configured to grip the aligned sheet at at least two spaced-apart points of the sheet and to release the sheet on a stack; and a holder configured to hold the sheet in position on the stack while the gripper arrangement releases the sheet. The gripper arrangement is movable along a predetermined trajectory for moving the sheet from the reference position to a stacking position.

9 Claims, 2 Drawing Sheets

(56) References Cited

U.S. PATENT DOCUMENTS

| | | | | |
|---|---|---|---|---|
| 2019/0210829 | A1* | 7/2019 | Rasmussen | B65H 43/00 |
| 2020/0130380 | A1* | 4/2020 | Yraceburu | B65H 29/045 |
| 2020/0130978 | A1* | 4/2020 | Tamura | B65H 29/125 |
| 2021/0395033 | A1* | 12/2021 | Kazama | B41J 13/0045 |

FOREIGN PATENT DOCUMENTS

| | | | | |
|---|---|---|---|---|
| JP | 2008-120547 | A | | 5/2008 |
| JP | 2008120547 | A | * | 5/2008 |
| JP | 2012-148854 | A | | 8/2012 |
| JP | 2013142017 | A | * | 7/2013 |
| WO | WO 2018/048430 | A1 | | 3/2018 |
| WO | WO2019/055035 | A1 | | 3/2019 |

* cited by examiner

SHEET STACKING APPARATUS

BACKGROUND OF THE INVENTION

1. Field of the Invention

The invention relates to a sheet stacking apparatus and a method fort stacking sheets.

2. Description of Background Art

It is known that a sheet stacking device may comprise:

- a sheet alignment mechanism configured for aligning a sheet in a predetermined reference position;
- a gripper arrangement configured to grip the aligned sheet at at least two spaced-apart points of the sheet and to release the sheet on a stack; and
- a holder configured to hold the sheet in position on the stack while the gripper arrangement releases the sheet.

US 2012267845 A1 discloses a sheet stacking apparatus of the type specified above, which may be used for example for stacking printed media sheets that are exiting from a printer. The alignment mechanism comprises a sheet flipping device for reversing the orientation of the sheet and for moving the sheet towards a stop until the leading edge of the sheet abuts the stop in a position in which the sheet is precisely aligned with a stack of sheets that have been stacked earlier. The gripper arrangement will then firmly hold the topmost sheet in position on the stack while a trailing part of the sheet leaves the flipping mechanism and flips-over until it lies flat on a support surface. Thus, the gripper arrangement can prevent the sheet from shifting from the target position due to its own inertia. However, the gripper arrangement has to release the sheet and has to be moved out of the way before the next sheet is aligned. In order for the sheet to be nonetheless positively held in position when the gripper arrangement is removed, the holder is activated for firmly holding the sheet against the top of the stack before the gripper arrangement releases the sheet and is removed. Then, when the sheet is neither subject to forces of inertia nor to any forces applied from the gripper arrangement, the holder is lifted again so that the next sheet can be supplied and aligned in the target position.

The known stacking apparatus can place the sheets in precisely aligned positions on the stack without causing any damage to the sheets, provided that the thickness and stiffness of the sheets vary only within a certain range. If the stiffness of the sheets is too low, it may fold upon itself during flipping. This undesired folding further prevents the sheet from being properly stacked. Additionally, if the sheets are too floppy, the edges of the sheets may get damaged when they are moved against the stop and/or are gripped by the gripper arrangement.

SUMMARY OF THE INVENTION

It is therefore an object of the invention to provide a sheet stacking apparatus that tolerates a larger bandwidth of thicknesses and stiffnesses of the sheets.

The sheet stacking device comprises:

- a sheet alignment mechanism configured for aligning a sheet in a predetermined reference position;
- a gripper arrangement configured to grip the aligned sheet at at least two spaced-apart points of the sheet and to release the sheet on a stack; and
- a holder configured to hold the sheet in position on the stack while the gripper arrangement releases the sheet.

In order to achieve this object, according to the invention, the gripper arrangement is movable along a predetermined trajectory for moving the sheet from the reference position to a stacking position.

Thus, in the apparatus according to the invention, the reference position where the sheets are aligned is different from the stacking position where the sheets are deposited on the stack. This has the advantage that the gripper arrangement, when gripping the sheet, does not have to be positioned on the top of the stack and can therefore smoothly engage the edge of the sheet from above and below. Then, when the gripped sheet is transferred from the reference position to the stacking position, the gripper arrangement is moved along a well-defined trajectory assuring that the alignment will not get lost during the transfer. For a proper alignment of the sheet relative to the stack in the direction of transfer of the sheet, it is sufficient to appropriately control the timings at which the holder is activated and the gripper arrangement releases the sheet.

More specific optional features of the invention are indicated in the dependent claims.

In order to achieve a high stacking frequency, the apparatus may comprise a plurality of gripper arrangements that move unidirectionally along a closed path, so that the sheets to be stacked can be supplied in close succession because they will be gripped by different gripper arrangements.

The invention also discloses a method for aligning and stacking sheets.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

Figure 1:
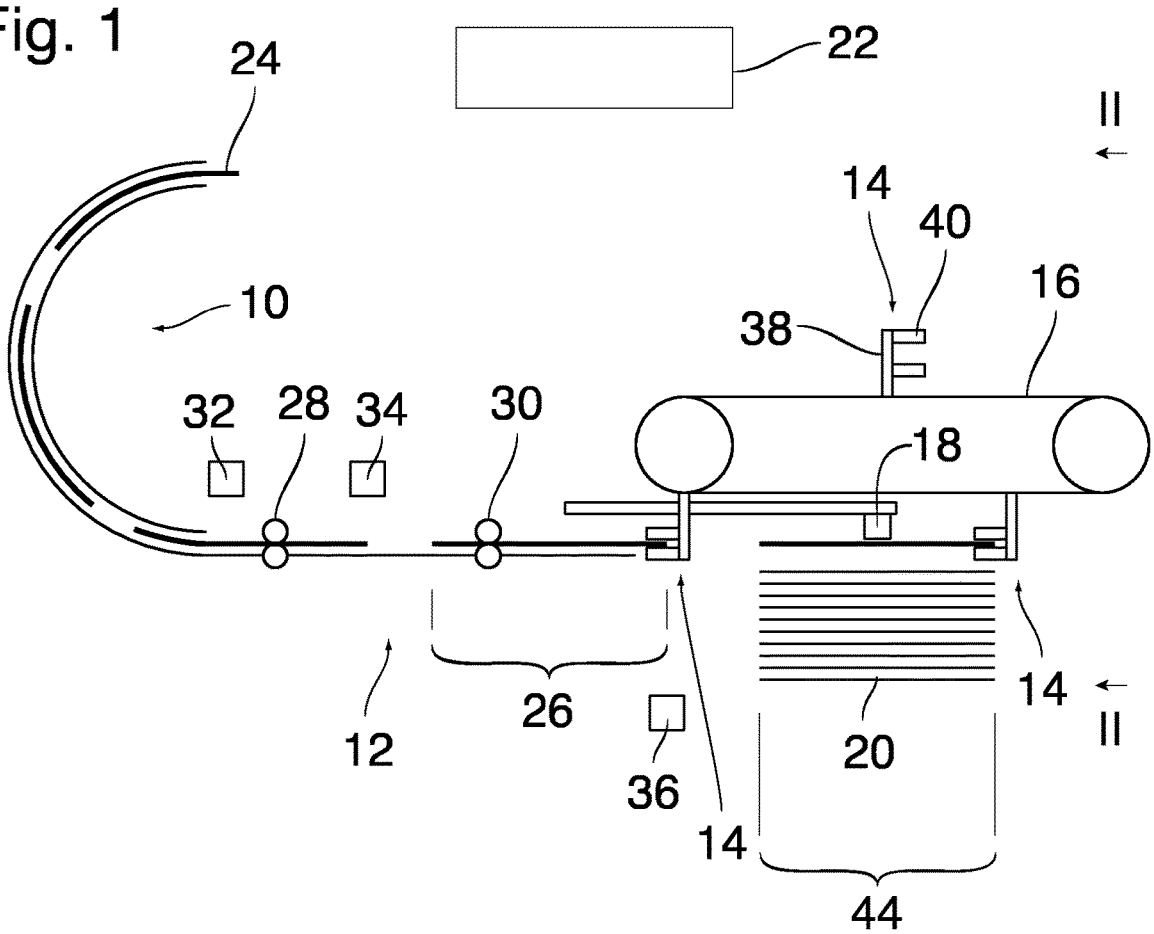
FIG. 1 is a schematic side view of a sheet stacking apparatus according to the invention.

The present invention will now be described with reference to the accompanying drawings, wherein the same reference numerals have been used to identify the same or similar elements throughout the several views.

The stacking apparatus shown in FIG. 1 comprises a sheet flipping mechanism 10, a sheet alignment mechanism 12, a number of gripper arrangements 14 mounted on an endless conveyor 16, a holder 18 mounted above a stack 20 of sheets and adapted to be moved downwards against the top of the stack, and a controller 22 controlling the operations of the various components of the apparatus.

The sheet flipping mechanism 10 takes the form of a semi-circular guide that receives media sheets 24 that exit from a discharge port of a printer (not shown) in close succession. For conveying the sheets 24 through their semi-circular path in the flipping mechanism 10, a number of pairs of drive rollers (not shown) may be provided along the transport path, or the transport path may be delimited on the radially inner side by a rotating drum. By way of example, it may be assumed that the sheets 24 have received an image on the top side in the (simplex) printer, and the flipping mechanism 10 reverses the orientations of the sheets so that they can be deposited on the stack 20 with the images facing downwards. The radius of the semi-circular transport path may be relatively large so that even relatively stiff sheets 24 can smoothly be handled.

The sheet alignment mechanism 12 is provided for aligning the sheets in a predetermined reference position 26 that has been symbolized here by two vertical lines that mark the positions of the leading edge and the trailing edge of the sheet in the reference position. In the example described here, the alignment mechanism is also capable of aligning the sheets in the lateral direction (normal to the plane of the drawing in FIG. 1). To that end, the alignment mechanism comprises two sets 28, 30 of drive rollers each of which comprises two pairs of rollers that are separated in the lateral direction, as can be seen (for the set 30) in FIG. 2 and which form nips for feeding the sheet at differential speeds. The drive roller set 28 conveys the sheets from the flipping mechanism 10 to the drive roller set 30 which will then take-over the sheets and convey them into the reference position 26. An optical sensor 32 detects a possible lateral offset of the sheets as they leave the sheet flipping mechanism 10, and the rollers of the set 28 are controlled to eliminate the lateral offset by rotating the sheet such that its leading edge will be aligned in the lateral direction at the time when it reaches the drive roller set 30. Another optical sensor 34 detects the skew angle of the sheet (which has been generated on purpose by the drive roller set 28), and the drive roller set 30 is then controlled to correct the skew angle while preserving the lateral alignment of the sheet.

Yet another optical sensor 36 detects the leading edge of the sheet at the time when the sheet reaches the reference position 26.

As is shown in FIG. 1, one of the gripper arrangements 14 on the conveyor 16 is in a position in which it can grip the leading edge of the sheet that has just arrived in the reference position 26.

Figure 2:
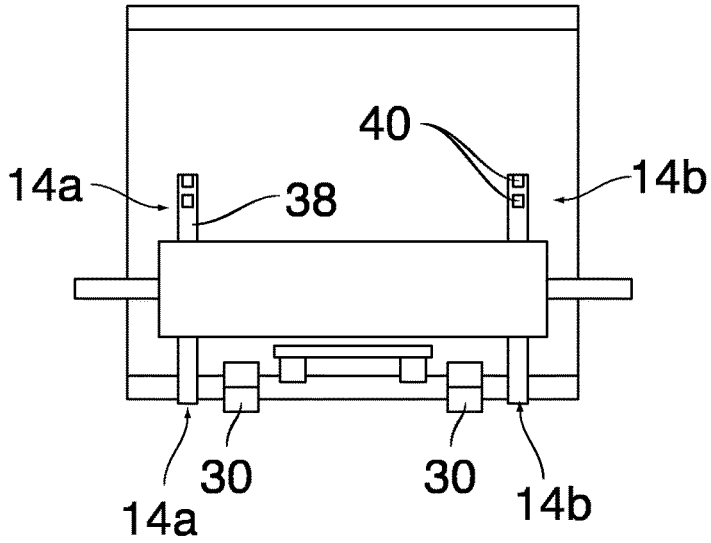
FIG. 2 is a view of the apparatus as seen in the direction of arrows II-II in FIG. 1.

In the example shown, the conveyor 16 has a total of three gripper arrangements 14 one of which is returning to the reference position on the upper run of the conveyor. As is shown in FIG. 2, each gripper arrangement 14 comprises two grippers 14*a* and 14*b* that are spaced apart from one another in the lateral direction. Each gripper has a post 38 that projects at right angles from the surface of the conveyor 16 and carries two pinch arms 40 at least one of which is movable along the post so that the leading edge of a sheet can be pinched between the two pinch arms.

It will be observed that the pinch arms 40 have a certain length in the conveying direction of the sheets, so that the relative position of the leading edge of the sheet and the pinch arms may vary within a certain range and the sheet can nevertheless be gripped safely. The conveyor 16 and the grippers are controlled such that each sheet is gripped at two points of its leading edge when the sheet is in the reference position 26. For example, the conveyor 16 may be driven at a constant speed such that the velocity of the gripper arrangements 14 is slightly smaller than the conveying speed of the sheets 24 in the alignment mechanism 12. Consequently, when moving towards the reference position, the leading edge of the sheet will slowly approach the grippers 14*a*, 14*b* that are moving in the same direction with a slightly smaller speed. The upper pinch arms 40 are lifted so that the sheet may smoothly enter into the space between the two pinch arms. As soon as the sensor 36 detects that the leading edge of the sheet is exactly in the reference position, the grippers 14*a*, 14*b* are closed, so that the sheet is firmly held in position relative to the gripper arrangement.

Although not shown in FIG. 2, the posts 38 of the two grippers 14*a*, 14*b* may be interconnected by a cross-bar so that this cross-bar, the two posts and the conveyor 16 form a rigid frame. When the conveyor 16 moves on, this rigid frame is moved along a straight trajectory that is defined by the transport direction of the conveyor, so that the sheet held in the grippers is subject to a parallel transport along this trajectory such that the skew angle of the sheet (ideally zero) and the lateral alignment of the sheet are preserved while the sheet is moved towards a stacking position 44 which has been symbolized here by two vertical lines marking the front and rear sides of the stack 20. It will be appreciated that instead of the two grippers 14*a*, 14*b*, a single, larger gripper may also be applied. This larger gripper sufficiently grips and holds the sheet at two different spaced apart points to prevent the sheet's skew angle and/or lateral position from changing uncontrollably during transport.

In FIG. 1, the holder 18 is held in a lifted position so that the sheet may be drawn onto the stack 20 without colliding with the holder. As is well known in the art, the stack 20 is formed on a lift table (not shown) that is height-controlled such that the top of the stack will always be at the same level, closely below the bottom ends of the gripper arrangements 14, so that the grippers do not collide with the stack when they draw a sheet onto the stack.

The controller 22 counts a fixed time interval from the time at which the grippers are closed to grip the sheet in the reference position 26. Based on the known distance between the reference position 26 and the stacking position 44 and on the known speed of a conveyor 16, this time interval is selected such that the sheet that is being drawn onto the stack 20 reaches the stacking position 44 exactly when this time interval lapses. At the expiry of this time interval, the holder 18 is lowered abruptly so as to quickly press the sheet onto the top of the stack while the grippers that have drawn the sheet onto a stack are opened so that they can release the sheet. This situation has been illustrated in FIG. 3 which shows the state of the apparatus just an instant later than in FIG. 1. The path of the sheet while held or engaged by the gripper 14*a*, 14*b* is preferably substantially linear, i.e. free of any sharp bends or turns to avoid damage to the sheet by folding or bending it. In the preferred embodiment shown in FIGS. 1 to 3, the path during use is substantially horizontal.

In this way, the new sheet is placed onto the top of the stack 20 in a precisely aligned position. Optionally, of course, an additional sensor could be provided for detecting the instant at which the sheet reaches the stacking position 44.

The holder 18 may be lifted again when the grippers have cleared the sheet and the sheet has come to rest on the stack.

Figure 3:
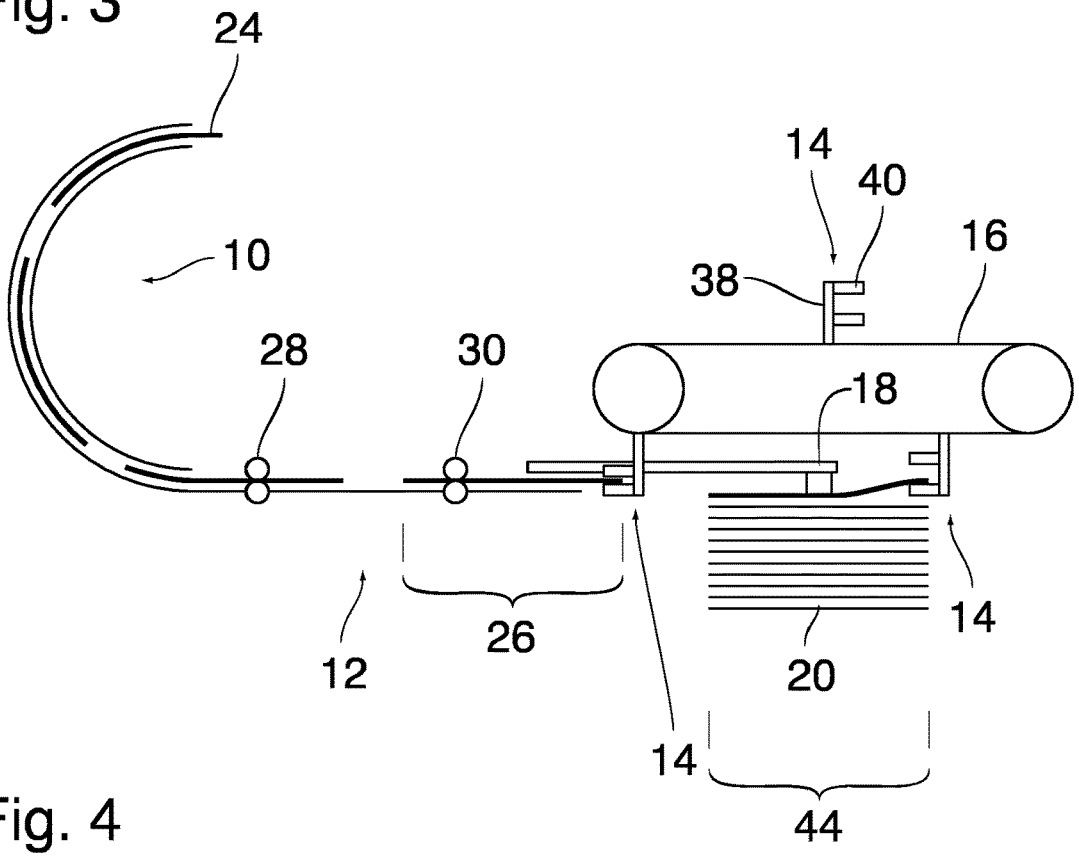
FIGS. 3 and 4 are views analogous to FIG. 1 but showing the apparatus in different states of operation.
Figure 4:
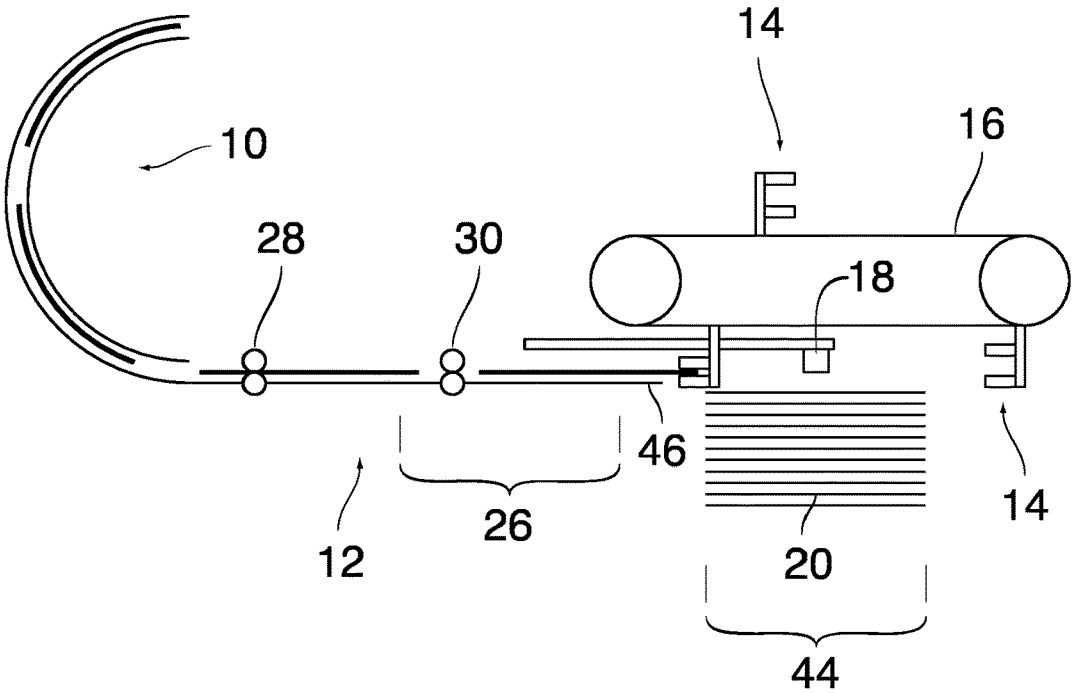

FIG. 4 illustrates the situation a short time later than in FIG. 3, so that the gripper arrangements 14 have moved on. The grippers that have released the edge of the sheet that was deposited on the stack 20 are left open until they reach the reference position 26 again, so that a new sheet can be fed into the space between the pinch arms 40. In FIG. 4, the grippers that hold a sheet in their pinch arms are just starting to drag the sheet onto the top of the stack 20. It will be observed that the trailing edge of that sheet is still supported by a horizontal guide 46 that defines the sheet transport path. Thus, due to friction, the sheet will be held under some tension so that it will not sag and will not contact the topmost sheet on the stack 20 while the grippers move on. The trailing edge of the sheet will clear the guide 46 only at the time when it has almost reached the stacking position.

It should be noted that, in this example, a stop against which the leading edge of the sheets should abut is needed neither to define the reference position 26 nor to define the stacking position 44, so that even very thin and delicate sheets can be handled safely.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A sheet stacking apparatus comprising:

a sheet alignment mechanism configured for aligning a sheet in a predetermined reference position;

a gripper arrangement downstream of the sheet alignment mechanism and configured to grip the aligned sheet at at least two spaced-apart points of the sheet and to release the sheet on a stack; and a holder configured to hold the sheet in position on the stack while the gripper arrangement releases the sheet, wherein the gripper arrangement is movable along a predetermined trajectory for moving the sheet from the reference position to a stacking position, wherein the gripping arrangement comprises two opposed gripping surfaces having an open position to receive the sheet and a closed position to retain the sheet, the gripping surfaces moving toward one another to move from the open position to the closed position, wherein the gripper arrangement is adapted to be moved unidirectionally along a closed path, wherein the gripper arrangement has a first end between the sheet alignment mechanism and the stack; and wherein a sheet flipping mechanism is provided upstream of the sheet alignment mechanism.

2. The apparatus according to claim 1, wherein the gripper arrangement is one of a plurality of gripper arrangements that are mounted on an endless conveyor.

3. The apparatus according to claim 2, wherein each of the plurality of gripper arrangements have a predetermined, fixed position with respect to the endless conveyor, such that the sheet is transported by the gripper arrangement in a position-controlled manner.

4. The apparatus according to claim 3, wherein the gripper arrangement is configured for maintaining the sheet aligned with respect to the reference position while transporting, and the holder is configured for securing the sheet aligned with respect to the reference position.

5. The apparatus according to claim 1, wherein the gripper arrangement is configured to grip a leading edge of the sheet.

6. The apparatus according to claim 5, wherein the gripper arrangement is one of a plurality of gripper arrangements that are mounted on an endless conveyor.

7. The apparatus according to claim 1, wherein the sheet alignment mechanism comprises a contactless sensor for detecting a time at which the leading edge of the sheet reaches the reference position, and a controller of the apparatus is configured to activate the gripper arrangement for gripping the sheet at that time.

8. The apparatus according to claim 1, wherein the sheet alignment mechanism is configured for aligning the sheets also in a lateral direction normal to the direction of movement of the gripper arrangement.

9. A sheet stacking apparatus comprising:

a sheet alignment mechanism configured for aligning a sheet in a predetermined reference position;

a gripper arrangement downstream of the sheet alignment mechanism and configured to grip the aligned sheet at at least two spaced-apart points of the sheet and to release the sheet on a stack; and a holder configured to hold the sheet in position on the stack while the gripper arrangement releases the sheet, wherein the gripper arrangement is movable along a predetermined trajectory for moving the sheet from the reference position to a stacking position, wherein the gripping arrangement comprises two opposed gripping surfaces having an open position to receive the sheet and a closed position to retain the sheet, the gripping surfaces moving toward one another to move from the open position to the closed position, wherein the gripper arrangement is adapted to be moved unidirectionally along a closed path, wherein the gripper arrangement has a first end between the sheet alignment mechanism and the stack, wherein the sheet alignment mechanism comprises a contactless sensor for detecting a time at which the leading edge of the sheet reaches the reference position, and a controller of the apparatus is configured to activate the gripper arrangement for gripping the sheet at that time, and wherein the controller is configured to determine the stacking position by integrating the transport speed of the gripper arrangement from the time at which the gripper arrangement has gripped the sheet, and controlling the gripper arrangement to release the sheet at the time when the leading edge of the sheet has travelled a predetermined distance and simultaneously activating the holder.

* * * * *